United States Patent [19]

Grazia

[11] Patent Number: 4,650,075

[45] Date of Patent: Mar. 17, 1987

[54] FILTER-BAG PACKAGE

[75] Inventor: Alessandro Grazia, Crevalcore, Italy

[73] Assignee: IMA-Industrie Macchine Automatiche SPA, Emilia, Italy

[21] Appl. No.: 706,075

[22] Filed: Feb. 27, 1985

[30] Foreign Application Priority Data

Feb. 28, 1984 [IT] Italy ..... 3362 A/84

[51] Int. Cl.[4] ..... B65D 85/16

[52] U.S. Cl. ..... 206/526; 206/44.11; 206/45.14; 206/45.19; 206/491; 206/554; 206/817; 229/44 R; 53/467; 53/474

[58] Field of Search ..... 206/44 R, 44 B, 45.14, 206/45.19, 45.15, 425, 499, 526, 554, 560, 565, 44.11, 491, 817, 821; 229/44 R; 53/467, 474, 484

[56] References Cited

U.S. PATENT DOCUMENTS

| | | | |
|---|---|---|---|
| 11,504 | 8/1884 | Woodbury | 206/425 |
| 1,916,227 | 7/1933 | Lorenzen | 206/45.14 |
| 2,078,018 | 4/1937 | Powell | 206/44 R |
| 2,124,335 | 7/1938 | Klein | 206/44.11 |
| 2,132,632 | 10/1938 | Kondolf | 206/45.14 |
| 2,287,005 | 6/1942 | Greaves | 206/565 |
| 3,185,382 | 5/1965 | Nunn | 206/491 |
| 3,315,936 | 4/1967 | Dautch | 206/45.14 |
| 3,443,354 | 5/1969 | Lindström | 53/484 |
| 3,633,330 | 1/1972 | Leonard | 206/554 |
| 3,687,278 | 8/1972 | Graham et al. | 206/44 R |
| 4,000,811 | 1/1977 | Hardison et al. | 206/44 R |
| 4,058,206 | 11/1977 | Morse et al. | 206/44 R |
| 4,396,115 | 8/1983 | Watson | 206/45.14 |
| 4,458,468 | 7/1984 | Siulech | 53/474 |
| 4,520,922 | 6/1985 | Beach | 206/44.11 |

*Primary Examiner*—Joseph Man-Fu Moy
*Assistant Examiner*—David T. Fidei
*Attorney, Agent, or Firm*—Karl F. Ross; Herbert Dubno

[57] ABSTRACT

In a box for packaging of filter bags for infusion products at their exit from a machine producing them obtained from a punched blank of cardboard in which with the aid of folding lines walls are defined for the bottom, cover and sides, the lateral walls of the box being provided with edges for connection and partial lengthwise covering of two opposite sides of the box, this box being further provided with one or more elements with partitioning walls such as to define at least two areas for the filter bags within the box for their containment one after the other in a corresponding number of rows parallel to each other, an element made of cardboard is also provided extending at least from the area or the interior surface of the bottom wall of the box until it comes to correspond to the cover wall, passing across a lateral wall and having at least one slit suited to engage a corresponding partition element in such a way that the mentioned cardboard element exercises an action of pressure on the rows of filter bags and of containment thereof towards and against the wall which locks the cover in its closed position.

7 Claims, 7 Drawing Figures

FILTER-BAG PACKAGE

FIELD OF THE INVENTION

My present invention relates to an improved box for packaging filter bags for infusion products at their exit from a machine which produces these bags and, more particularly, to a filter-bag package.

BACKGROUND OF THE INVENTION

Generally machines for the production of filter bags for infusion products and boxes for their packaging are structured to define a plurality of operational sections, interconnected in a way that ensures that each carries out its own task in perfect coordination with the others for high production speeds.

For instance a well known machine of this type manufactured and sold by IMA-Industria Macchine Automatiche-S.p.A., Ozzano Emilia (Bo) Italy, under the trademark MA C55, an object of numerous patent applications and granted patents, can be thought of as essentially having three sections, the first of which serving for the production of groups of individual filter bags containing the infusion product is fast, a second section which is slow with respect to the first for the formation of open boxes by glueing from punched blanks of cardboard fed into a supply hopper, and a third section, also slow compared to the first for filling the open boxes with the groups of filter bags and closing the box.

A feature of this machine is that the operational cycle of the machine section for the production of the open boxes is complete and independent, but within the cycle of the two other machine sections for the production of groups of filter bags and for the filling of the box with the groups of filter bags.

In practice it often happens that such boxes are to be only partially filled with groups of filter bags, and in this case, one finds upon checking either in the closing stage of the boxes are between production and retail sale, that the filter bags are scattered within the box, even when the filter bags have been arranged one after the other in rows well separated from each other by cardboard partitions, resulting in partial squashing of the boxes during the mentioned handling and conferring a disorderly and unpleasant appearance of the filter bags contained in the box when it is opened.

OBJECTS OF THE INVENTION

The principal object of the present invention is to completely avoid the above inconveniences by providing a punched blank for the formation of boxes in the above-mentioned machine capable to ensure the correct arrangement in rows one after the other of the filter bags within these boxes at all times from their closing until they are opened for the use of the filter bags contained therein.

It is also an object of the present invention to provide an improved method of packaging filter bags.

Another object of my present invention is to provide a punched blank for the formation of boxes according to the preceding object, in a manner that is particularly simple and economical when the resulting advantages are taken into account.

It is another object of the present invention to provide an improved filter-bag package avoiding the disadvantages outlined above.

SUMMARY OF THE INVENTION

These and other objects which will become evident in the following will be all attained by the box according to the invention for the packaging of filter bags for infusion products at their exit from a machine which produces them, this box being made from a punched blank of cardboard wherein by means of folding lines walls are separately defined for the bottom, the cover and the sides of the box, the latter being provided with strips for connection and partial lengthwise covering of two opposite sides of the box and further provided with one or more elements defining partitions in order to delimit within the box at least two areas of containment of the filter bags, arranged one after another according to a corresponding number of rows parallel to each other.

According to the invention as an integral part of the blank a cardboard element is provided which extends at least from the internal area or face of the bottom wall then crosses a lateral wall until it reaches close to the extremity of the cover which is defined as an extension of the peripheral wall, this cardboard element having at least one slit extending transversally to the mentioned peripheral wall from a position close to the bottom wall to a position close to the extremity of the mentioned cardboard element and being capable to receive a partition element in such a way that the cardboard element or tongue, applies pressure on or each of the row of filter bags and holds the rows in a stable position with respect to the lateral wall and to the cover, preferably also locking the cover in its closed position, opposite to the articulation of this cover.

BRIEF DESCRIPTION OF THE DRAWING

Further characteristics and advantages of the box according to the present invention for packaging filter bags for infusion products at their exit from the machine producing them will be apparent from the detailed description of two embodiments with reference to the drawing in which.

SPECIFIC DESCRIPTION

Figure 1:
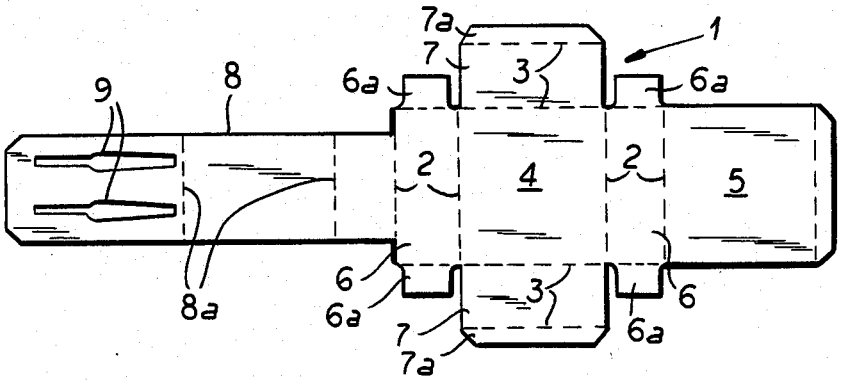
FIG. 1 shows a top view of the fully developed cardboard blank according to a first embodiment thereof for production of the box of the invention.
Figure 6:
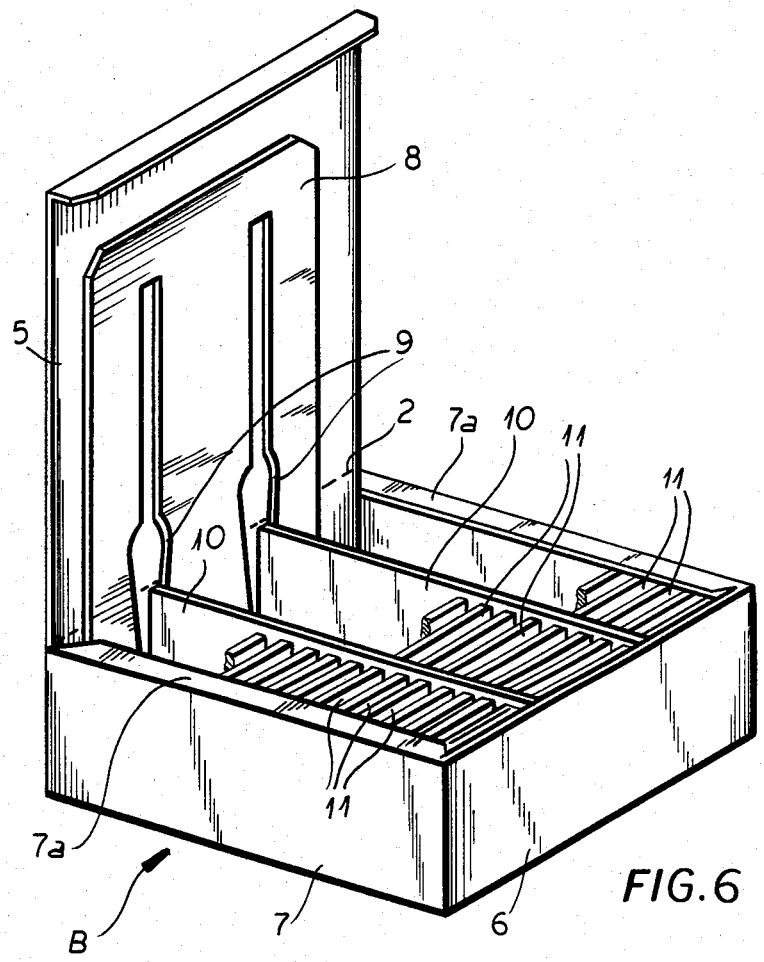
FIG. 6 is a perspective view of a box obtained from the cardboard blanks of FIGS. 1, 2, or 3, 4 and 5 in open position.
Figure 7:
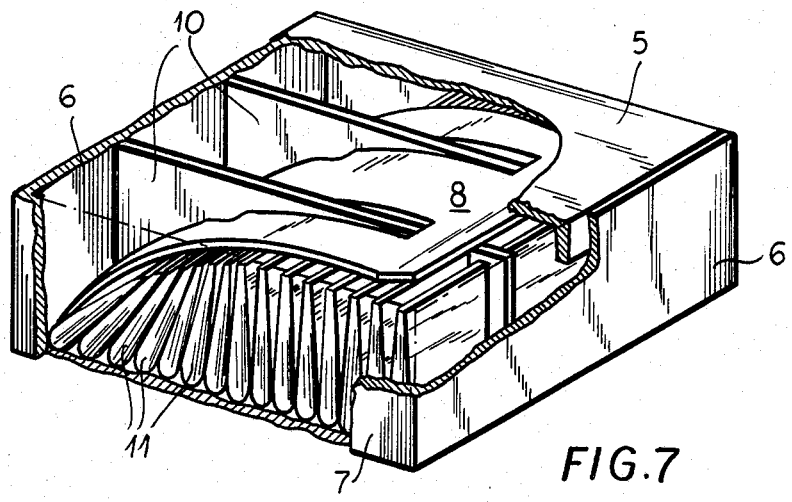
FIG. 7 is a perspective view of the box of FIG. 6 but in its closed position, with some of its parts in section and others removed or broken away, to better illustrate the remaining parts.

In FIG. 1 as mentioned above, the cardboard blank 1 is shown according to a first embodiment of the box of the invention (see FIGS. 6 and 7).

In this cardboard blank, by means of transversal folding lines 2 and longitudinal folding lines 3 the bottom 4, the cover flap 5 and the peripheral transversal walls 6 as well as the peripheral transversal walls 7 are defined, with the peripheral transversal walls 6 provided with connection elements or flaps 6a and the longitudinal peripheral walls 7 provided with the wings 7a for partial lengthwise covering of two opposite sides of the box B (see FIG. 6).

Opposite to the cover wall 5 the corresponding transversal peripheral wall 2 continues with a cardboard portion having an element 8 provided with transversal folding lines 8a and also with two longitudinal slits 9 in its terminal section, whose purpose will become apparent.

Figure 2:
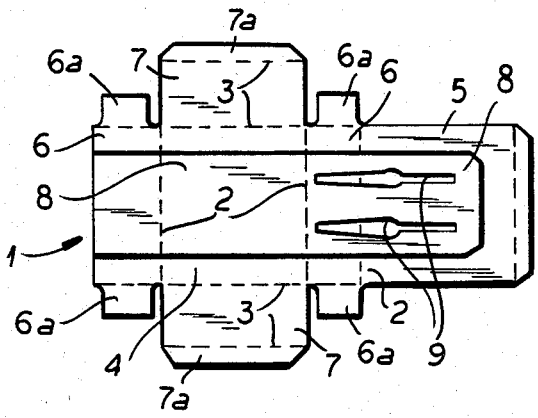
FIG. 2 is a top view of the same cardboard blank as in FIG. 1 in an intermediate stage of the production of the box according to the invention.

For the formation of the box B according to the invention using such a punched blank 1 the element 8 is folded longitudinally at along the transversal folding line 2 whereby it extends over the adjacent transversal peripheral wall 6 with the folding line 8a coinciding with the transversal folding line 2 defining the bottom wall 4 proximal to the cover and with its terminal segment provided with slits 9 corresponding to the cover wall 5, as can be seen in FIG. 2.

With this arrangement of the cardboard blank 1 the box B is formed as seen in FIG. 6 using traditional means for glueing the flaps 6a, for the introduction in the box of the partition walls 10 engageable into the slits 9 of the element 8, for the filling of the box B with the rows of filter bags 11 one after the other and for the folding towards the inside of the box B of the wings 7a, as can also be seen from the mentioned FIG. 6.

In the aforementioned case of partial filling of the box B with rows of filter bags 11 somewhat loose in the containment compartment, upon closing of the cover 5, because of the presence of the element or tongue 8 reaching up from fold of the junction of the rear wall and the bottom, a pressure is exerted to maintain in stable position the rows of filter bags 11 pressing them towards and against the peripheral transversal wall 6 which locks the cover in the closed position (see FIG. 7) thus eliminating all the inconveniences mentioned before with reference to boxes of this type.

Figure 3:
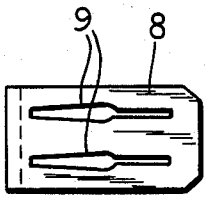
FIGS. 3 and 4 are top views of the elements constituting the cardboard blank according to a second embodiment meant for the production of a similar box.
Figure 4:
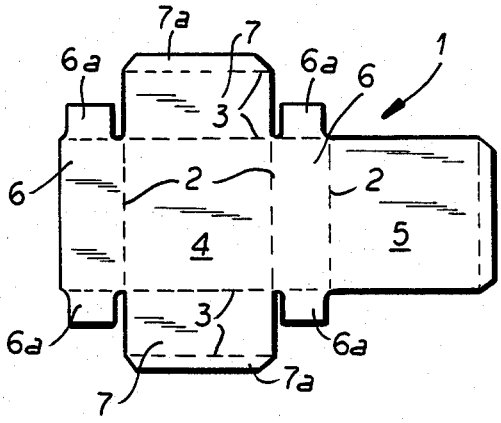
Figure 5:
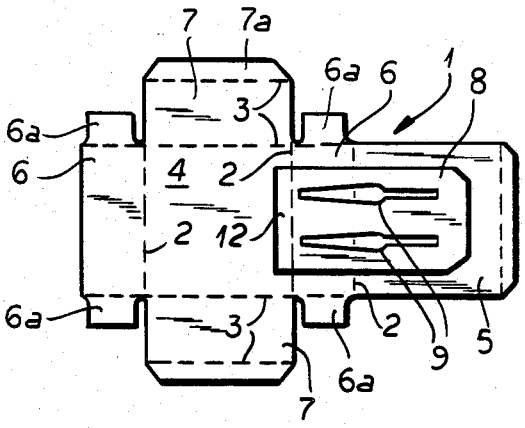
FIG. 5 is another top view of the combination of elements represented in FIGS. 3 and 4 corresponding to an intermediate stage in the production of the latter box.

Similar results are obtainable also with the boxes B obtained from the cardboard blank as shown in FIGS. 3, 4 and 5, wherein the corresponding elements are marked with the same numerals used for FIGS. 1 and 2. Such a punched cardboard blank according to FIGS. 3, 4 and 5 differs from the one shown in FIGS. 1 and 2 only by the fact that the element 8 is separated from the rest of the cardboard blank and is affixed in a known manner, for instance through pasting, to the face of the bottom wall 4 is clearly marked with the numeral 12 in FIG. 5, at the junction of the front wall 6 and the cover.

With such blanks it is possible to achieve in practice all the proposed objects.

I claim:

1. In a box for packaging rows of filter bags for infusion products having folding lines defining a bottom wall, a cover wall and front, lateral and rear peripheral walls at least some of which are provided with connection flaps for interconnection and partial lengthwise covering of two opposite sides of the box and further provided with one or more partitions in order to define within the box at least two areas of containment for the respective rows, the improvement which comprises:

a flexible cardboard element affixed at one end to at least one of said front and bottom walls and extending at least from a face of said bottom wall across an adjoining rear peripheral wall to a junction of said rear peripheral wall and a junction of said cover wall therewith underlying said cover wall and overhanging said rows and bearing thereon when the cover wall is closed, said cardboard element having at last one slit extending transversely to the said rear peripheral wall from a position close to the aforementioned bottom wall to a position close to a free extremity of said cardboard element and capable of receiving said partition following the folding of the cover wall into a closed position of the cover wall so as to cause said element to exert a pressure on the filter bags towards and against a front peripheral wall against which the cover wall rests in said closed position, and wherein:

said cover wall is affixed to an upper end of said rear peripheral wall so that upon closure a continuously curved free tongue formed by said element between a junction of said bottom wall with said rear peripheral wall and said free extremity projects toward said front peripheral wall to press on the filter bags.

2. The improvement defined in claim 1 wherein said cardboard element is defined by a folding line on an extension of said front peripheral wall, is folded over said front peripheral wall, over said bottom wall, and over said rear wall, and partially underlies said cover wall.

3. The improvement defined in claim 1 wherein said cardboard element is affixed to an internal face of said bottom wall, in the proximity of said rear peripheral wall.

4. A filter-bag package, comprising:

a box formed with at least one partition defining at least two compartments extending from a rear wall to a front wall of said box, a cover articulated to said rear wall and having a flap adapted to rest against said front wall in a closed position of said cover, and a bottom underlying said compartments;

respective rows of filter bags in said compartments; and a flexible tongue rising from said bottom adjacent said rear wall, underlying said cover and having a slit receiving said partition whereby said tongue is continuously curved from said bottom toward said front wall and bears upon said rows and urges said filter bags toward said front wall in said closed position of said cover.

5. The package defined in claim 4 wherein said partition, said cover, said bottom, said front wall and said rear wall are all integral with one another.

6. The package defined in claim 5 wherein said tongue is integral with said cover, said bottom, said front wall, said rear wall, and said partition.

7. The package defined in claim 6 wherein said cover is pasted to said bottom.

* * * * *